US009532403B2

(12) United States Patent
Kielar

(10) Patent No.: US 9,532,403 B2
(45) Date of Patent: Dec. 27, 2016

(54) HEATABLE SURFACE DEVICE

(71) Applicant: Paul Kielar, Hamilton (CA)

(72) Inventor: Paul Kielar, Hamilton (CA)

( * ) Notice: Subject to any disclaimer, the term of this patent is extended or adjusted under 35 U.S.C. 154(b) by 445 days.

(21) Appl. No.: 14/096,591

(22) Filed: Dec. 4, 2013

(65) Prior Publication Data

US 2015/0156819 A1 Jun. 4, 2015

(51) Int. Cl.
*H05B 1/02* (2006.01)
*H05B 3/20* (2006.01)

(52) U.S. Cl.
CPC ..... *H05B 3/20* (2013.01); *H05B 2203/003* (2013.01); *H05B 2203/013* (2013.01); *H05B 2203/02* (2013.01); *Y10T 29/49083* (2015.01)

(58) Field of Classification Search
CPC ..... H05B 3/20; H05B 3/12; H05B 2203/003; H05B 2203/013; H05B 2203/02; Y10T 29/49083
USPC ..... 219/216, 509, 504, 505, 543
See application file for complete search history.

(56) References Cited

U.S. PATENT DOCUMENTS 4,777,351 A * 10/1988 Batliwalla ..... H01C 7/027 219/528
5,674,423 A 10/1997 Wright, Sr.
5,686,005 A 11/1997 Wright, Sr.
6,137,669 A * 10/2000 Chiang ..... G01K 3/14 361/103
7,232,976 B1 6/2007 Catalano
2007/0007267 A1* 1/2007 Rayl ..... B41M 1/04 219/217
2008/0099456 A1* 5/2008 Schwenke ..... H05B 3/86 219/203

FOREIGN PATENT DOCUMENTS

| | | |
|---|---|---|
| CN | 201035548 | 3/2008 |
| CN | 201293981 | 8/2009 |
| CN | 201725301 | 1/2011 |
| CN | 201788483 | 4/2011 |
| CN | 202003314 | 10/2011 |
| CN | 202677324 | 1/2013 |
| DE | 295 05 966 | 7/1995 |
| DE | 298 18 988 | 6/1999 |
| FR | 2 853 740 | 10/2004 |
| WO | WO-02/087284 | 10/2002 |

* cited by examiner

*Primary Examiner* — Mark Paschall
(74) *Attorney, Agent, or Firm* — Norris McLaughlin & Marcus, P.A.

(57) ABSTRACT

A capacitive sensor electrode for controlling activation and deactivation of a PTC conductive ink heater can be deposited as part of the same layer of conductive ink used to form the open heater circuit pattern for the heater. A layer of conductive ink is deposited on an insulating substrate, with a first portion of the layer forming an open heater circuit pattern and a second portion of the layer forming a capacitive sensor electrode spaced from and electrically isolated from the first portion of the layer. A layer of positive temperature coefficient (PTC) conductive ink is deposited so as to bridge gaps between in the open heater circuit pattern while leaving the capacitive sensor electrode spaced from and electrically isolated from the layer of PTC conductive ink on the first portion of the layer of conductive ink.

10 Claims, 3 Drawing Sheets

HEATABLE SURFACE DEVICE

TECHNICAL FIELD

The present disclosure relates to heaters, and more particularly to heaters incorporating positive temperature coefficient (FTC) conductive ink.

BACKGROUND

It is generally known to construct heating elements by depositing conductive ink onto a substrate to form an open heater circuit pattern and then depositing PTC conductive ink over the conductive ink. Current designs known to the inventor, however, require cumbersome steps to integrate control circuitry, and make it difficult to incorporate sensors for automatically switching the heater on and off.

SUMMARY

A capacitive sensor electrode for use in controlling activation and deactivation of a PTC conductive ink heater can be deposited as part of the same layer of conductive ink used to form the open heater circuit pattern.

A heatable surface element comprises an insulating substrate and a layer of conductive ink on the substrate. A first portion of the layer of conductive ink is arranged to form an open heater circuit pattern comprising a plurality of heater conductive paths separated from one another by gaps therebetween. A second portion of the layer of conductive ink is arranged to form a capacitive sensor electrode spaced from and electrically isolated from the first portion of the layer of conductive ink by a peripheral isolation region surrounding the capacitive sensor electrode. A layer of positive temperature coefficient (PTC) conductive ink on the substrate and the first portion of the layer of conductive ink is in electrical communication therewith to bridge the gaps between the heater conductive paths of the open heater circuit pattern. The capacitive sensor electrode is spaced from and electrically isolated from the layer of PTC conductive ink on the first portion of the layer of conductive ink by the peripheral isolation region. The first and second portions of the layer of conductive ink and the layer of PTC conductive ink are disposed between the substrate and at least one sealing layer.

In one preferred embodiment, a third portion of the layer of conductive ink is arranged to form control circuit conductive paths for a control circuit. The third portion of the layer of conductive ink is electrically coupled to the first portion of the layer of conductive ink and to the second portion of the layer of conductive ink so as to maintain electrical isolation therebetween. In one particular embodiment, at least component connection regions of the third portion of the layer of conductive ink are unsealed by the sealing layer.

The sealing layer(s) may comprise a coating of sealant over the first and second portions of the layer of conductive ink and over the layer of PTC conductive ink, or may comprise a sheet adhered over the first and second portions of the layer of conductive ink and over the layer of PTC conductive ink.

In one embodiment, the capacitive sensor electrode is free of PCT conductive ink.

A heater may comprise a heatable surface element as described above in combination with a control circuit. The control circuit includes the control circuit conductive paths formed by the third portion of the layer of conductive ink, as well as a capacitive switch incorporating the capacitive sensor electrode and adapted to selectively control flow of electrical current through the first portion of the layer of conductive ink and the layer of PTC conductive ink in response to the capacitive switch. The first portion of the layer of conductive ink and the second portion of the layer of conductive ink are in electrical communication with one another only through the control circuit;

A method of making a heatable surface for a heater comprises depositing a layer of conductive ink on an insulating substrate. A first portion of the layer of conductive ink is arranged to form an open heater circuit pattern comprising a plurality of heater conductive paths separated from one another by gaps therebetween, and a second portion of the layer of conductive ink is arranged to form a capacitive sensor electrode spaced from and electrically isolated from the first portion of the layer of conductive ink by a peripheral isolation region surrounding the capacitive sensor electrode. The first portion of the layer of conductive ink and the second portion of the layer of conductive ink are electrically isolated from one another. The method further comprises depositing a layer of positive temperature coefficient (PTC) conductive ink on the substrate and the first portion of the layer of conductive ink in electrical communication therewith to bridge the gaps between the heater conductive paths of the open heater circuit pattern. The layer of PTC conductive ink is deposited so that the capacitive sensor electrode is spaced from and electrically isolated from the layer of PTC conductive ink on the first portion of the layer of conductive ink by the peripheral isolation region.

The method may further comprise sealing the first and second portions of the layer of conductive ink and the layer of PTC conductive ink. Sealing the first and second portions of the layer of conductive ink and the layer of PTC conductive ink may comprise applying at least one coating of insulating sealant over the first and second portions of the layer of conductive ink and over the layer of PTC conductive ink. Sealing the first and second portions of the layer of conductive ink and the layer of PTC conductive ink may also comprise adhering at least one insulating sheet over the first and second portions of the layer of conductive ink thereof and over the layer of PTC conductive ink.

Preferably, a third portion of the layer of conductive ink is arranged to form control circuit conductive paths for a control circuit, and the third portion of the layer of conductive ink is electrically coupled to the first portion of the layer of conductive ink and to the second portion of the layer of conductive ink so as to maintain electrical isolation therebetween. In such implementations, the method may further comprise electrically coupling electrical components to the third portion of the layer of conductive ink to form a control circuit that includes a capacitive switch incorporating the capacitive sensor electrode and is adapted to selectively control flow of electrical current through the first portion of the layer of conductive ink and the layer of PTC conductive ink in response to the capacitive switch, with the first portion of the layer of conductive ink and the second portion of the layer of conductive ink being in electrical communication with one another only through the control circuit. The method may further comprise sealing the third portion of the layer of conductive ink after electrically coupling the electrical components thereto.

BRIEF DESCRIPTION OF THE DRAWINGS

These and other features will become more apparent from the following description in which reference is made to the appended drawings wherein.

DETAILED DESCRIPTION

Figure 1:
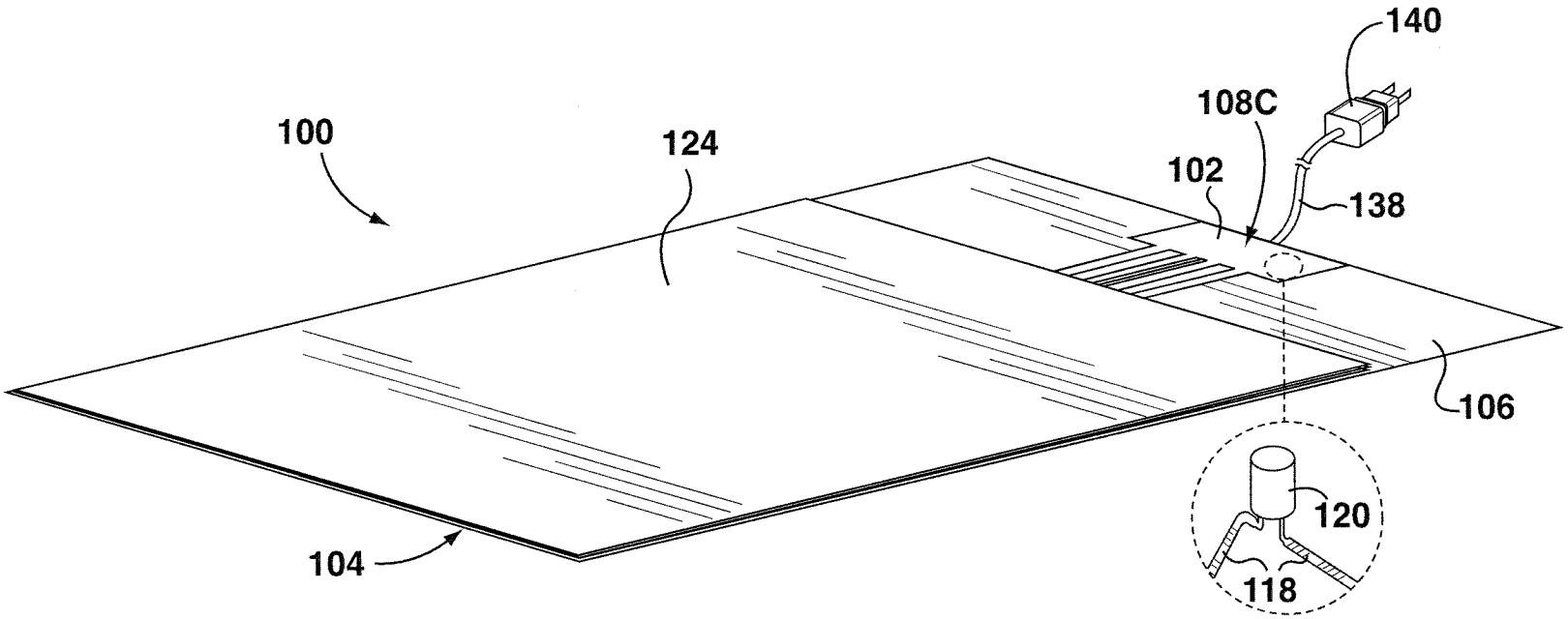
FIG. 1 is a perspective view of an exemplary heater.

Reference is now made to FIG. 1, which shows an exemplary heater, denoted generally by reference numeral 100. The heater 100 comprises a control circuit 102 and a heatable surface element 104. The exemplary heater 100 takes the form of a heatable mouse pad, but heaters as described herein are not limited to such applications.

Figure 2:
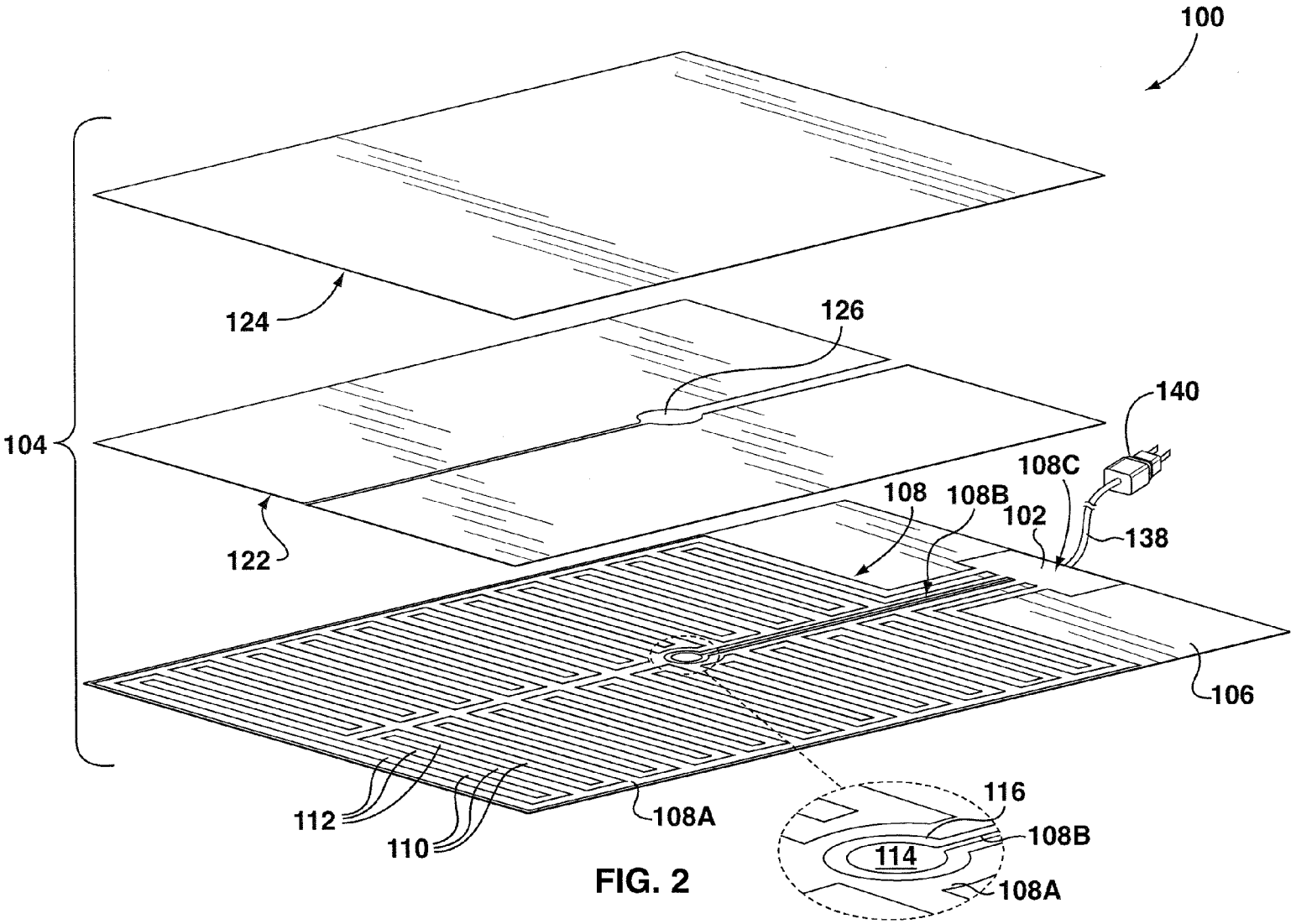
FIG. 2 is an exploded perspective view of the heater of FIG. 1.

Referring now to FIG. 2, which is an exploded view of the heater of FIG. 1, it can be seen that the heatable surface element 104 comprises an insulating substrate 106 and a layer of conductive ink 108 on the substrate 106. In the illustrated embodiment, the substrate is a plastic sheet although other suitable materials may also be used. A first portion 108A of the layer of conductive ink 108 is arranged to form an open heater circuit pattern comprising a plurality of heater conductive paths 110 separated from one another by gaps 112 therebetween, as can be seen in FIG. 2. A second portion 108B of the layer of conductive ink 108 is arranged to form a capacitive sensor electrode 114 spaced from and electrically isolated from the first portion 108A of the layer of conductive ink 108 by a peripheral isolation region 116 surrounding the capacitive sensor electrode 114, as shown in the enlarged portion of FIG. 2. The pattern shown in FIG. 2 is merely exemplary, and a wide variety of patterns may be provided which form an open heater circuit pattern and a capacitive sensor electrode. The conductive ink may be, for example, a sliver-based conductive ink or a copper-based conductive ink.

As can be seen in FIG. 2, the first portion 108A of the layer of conductive ink 108 and the second portion 108B of the layer of conductive ink 108 are in electrical communication with one another only through the control circuit 102. The control circuit 102 is shown as a block for simplicity of illustration; in a preferred embodiment a third portion 108C of the layer of conductive ink 108 is arranged to form control circuit conductive paths 118 for the components 120 of the control circuit 102, as can be seen in the enlarged portion of FIG. 1. This third portion 108C of the layer of conductive ink 108 is electrically coupled to the first portion 108A of the layer of conductive ink 108 and to the second portion 108B of the layer of conductive ink 108 so as to maintain electrical isolation therebetween except through the control circuit 102. Equivalently, the third portion 108C of the layer of conductive ink 108 may simply comprise connector leads for a complete control circuit that is assembled separately and then connected to the leads.

The heatable surface element 104 further comprises a layer of PTC conductive it 122, which is disposed on the substrate 106 and on the first portion 108A of the layer of conductive ink 108. The layer of PTC conductive ink 122 may be, for example, PTC carbon ink. The layer of PTC conductive ink 122 is in electrical communication with the first portion 108A of the layer of conductive ink 108, and bridges the gaps 112 between the heater conductive paths 110. The capacitive sensor electrode 114 is spaced from and electrically isolated from the layer of PTC conductive ink 122 on the first portion 108A of the layer of conductive ink 108 by the peripheral isolation region 116, which is free of PTC conductive ink. Although it is possible to deposit PTC conductive ink on the capacitive sensor electrode 114 itself as long as the peripheral isolation region 116 remains unbridged by PTC conductive ink, preferably the capacitive sensor electrode 114 is free of PCT conductive ink and the layer of PTC conductive ink 122 defines a relief region 126 that omits any PTC conductive ink and is in registration with the capacitive sensor electrode 114 and the peripheral isolation region 116.

In the illustrated embodiment, at least one sealing layer 124 is disposed over the layer of conductive ink 108, other than the third portion 108C thereof, and the layer of PTC conductive ink 122, so that the layer of conductive ink 108, other than the third portion 108C thereof, and the layer of PTC conductive ink 122 are disposed between the substrate 106 and the sealing layer(s) 124. The sealing layer(s) 124 may comprise one or more coatings of sealant over the substrate 106, the layer of conductive ink 108 other than the third portion 108C thereof, and the layer of PTC conductive ink 122, or may comprise a sheet adhered over the substrate 106, the layer of conductive ink 108 other than the third portion 108C thereof, and the layer of PTC conductive ink 122.

As can be seen in the Figures, in the illustrated embodiment the sealing layer 124 does not cover the third portion 108C of the layer of conductive ink 108, so as to facilitate connection of the electronic components 120 making up the control circuit 102 to the control circuit conductive paths 118 (see enlarged portion of FIG. 1). Equivalently, the sealing layer 124 may cover part of the third portion 108C of the layer of conductive ink 108, but be omitted from the component connection regions; i.e. the parts of the control circuit conductive paths where circuit components are to be connected. Also equivalently, the sealing layer 124, or a separate sealing layer, may be applied to the third portion 108C of the layer of conductive ink 108 after the electronic components 120 have been connected to the control circuit conductive paths 118.

The control circuit 102 includes a capacitive switch incorporating the capacitive sensor electrode 114, and is adapted to selectively control the flow of electrical current through the first portion 108A of the layer of conductive ink 108 and the layer of PTC conductive ink 122 in response to the capacitive switch, as described further below. When current flows through the first portion 108A of the layer of conductive ink 108 and the layer of PTC conductive ink 122, the layer of PTC conductive ink 122 provides resistance to the current flow and increases in temperature. Electrical power is preferably supplied to the control circuit 102 via an electrical cord 138 connected to an electrical outlet (not shown) via a suitable step-down transformer plug 140, for example a 120V AC to 12V DC transformer plug.

The control circuit 102 is configured so that when an object, such as a user's hand, is moved above the capacitive sensor electrode 114 so as to trigger the capacitive switch, electrical current is allowed to flow through the first portion 108A of the layer of conductive ink 108 and the layer of PTC conductive ink 122 to heat the layer of PTC conductive ink 122. In a preferred embodiment, the control circuit 102 includes a timer and will continue to permit electrical current to flow through the first portion 108A of the layer of conductive ink 108 and the layer of PTC conductive ink 122 for a predetermined period of time after movement is detected. The timer is reset each time movement is detected so that electrical current will continue to flow through and heat the layer of PTC conductive ink 122 as long as there is sufficiently frequent movement. If the predetermined time elapses with no movement being detected, the control circuit 102 would then inhibit flow of electrical current through the first portion 108A of the layer of conductive ink 108 and the layer of PTC conductive ink 122, effectively turning off the heater 100. Also preferably, the control circuit 102 is configured so that when it first receives power (e.g., when the plug 140 is plugged into a wall socket), electrical current is immediately permitted to flow through the first portion 108A of the layer of conductive ink 108 and the layer of PTC conductive ink 122 and the timer started, rather than waiting for movement to be detected. Design and construction of a suitable control circuit is within the capability of one skilled in the art, now informed by the present disclosure.

Figure 3:
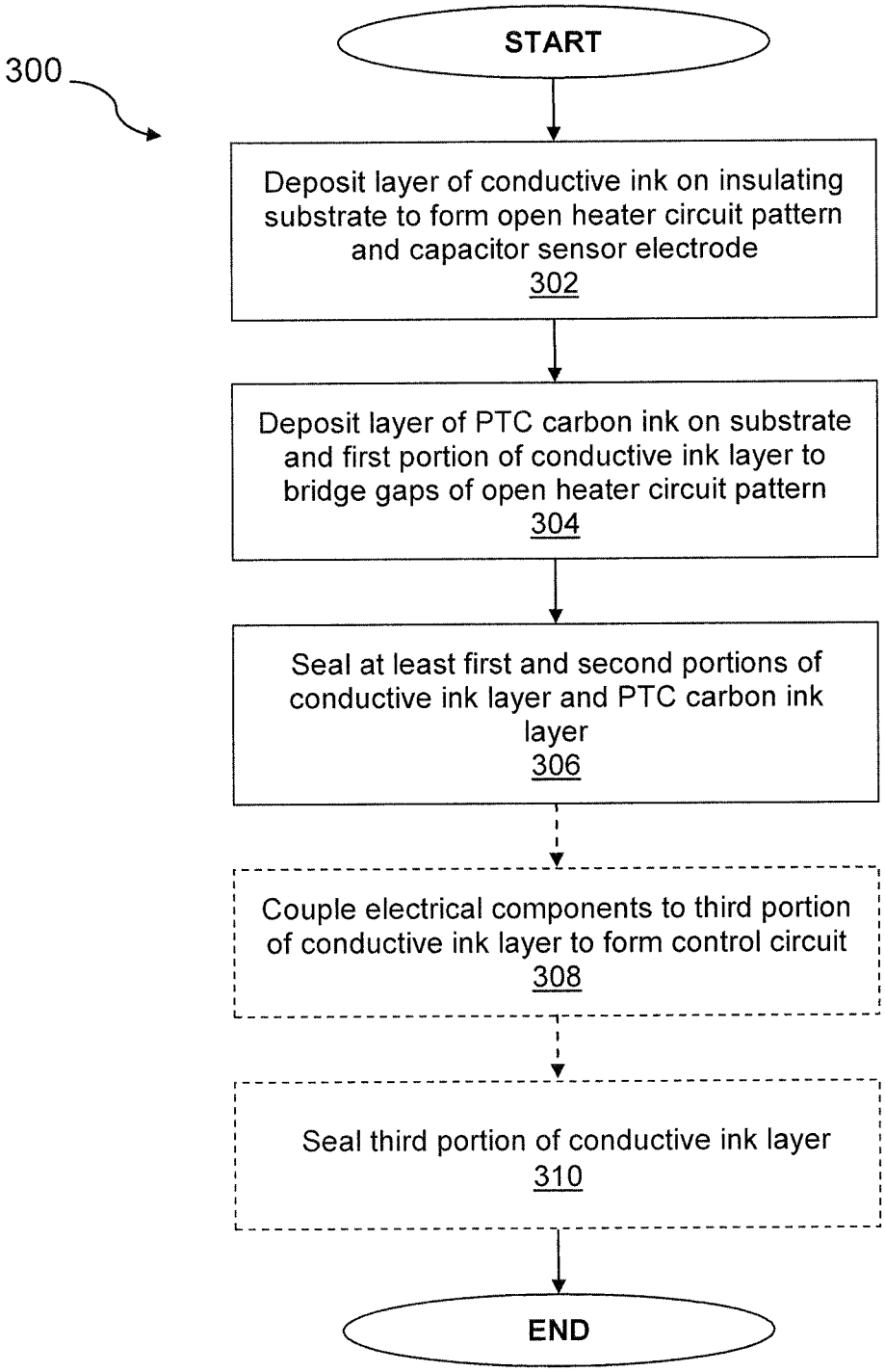
FIG. 3 is a flow chart showing a method of making a heatable surface for a heater.

Reference is now made to FIG. 3, which is a flow chart showing an exemplary method 300 for making a heatable surface for a heater. At step 302, a layer of conductive ink is deposited on an insulating substrate. The substrate may be, for example, a plastic sheet. A first portion of the layer of conductive ink is arranged to form an open heater circuit pattern comprising a plurality of heater conductive paths separated from one another by gaps therebetween, and a second portion of the layer of conductive ink is arranged to form a capacitive sensor electrode spaced from and electrically isolated from the first portion of the layer of conductive ink by a peripheral isolation region surrounding the capacitive sensor electrode. The first portion of the layer of conductive ink and the second portion of the layer of conductive ink are electrically isolated from one another at step 302, and the layer of conductive ink may have, for example, the pattern shown in FIG. 2, or may have a different pattern. Preferably, the layer of conductive ink deposited at step 302 includes a third portion arranged to form control circuit conductive paths for a control circuit, with the third portion of the layer of conductive ink being electrically coupled to the first portion of the layer of conductive ink and to the second portion of the layer of conductive ink so as to maintain electrical isolation therebetween. In particular, because at step 302 the electrical components of the control circuit have not been attached, the control circuit conductive paths formed by the third portion of the layer of conductive ink do not form a complete circuit.

At step 304, a layer of positive temperature coefficient (PTC) conductive ink is deposited on the substrate and on the first portion of the layer of conductive ink in electrical communication therewith to bridge the gaps between the heater conductive paths of the open heater circuit pattern. The layer of PTC conductive ink is deposited so that the capacitive sensor electrode is spaced from and electrically isolated from the layer of PTC conductive ink on the first portion of the layer of conductive ink by the peripheral isolation region. For example, the layer of PCT conductive ink may have the pattern shown in FIG. 2.

Standard printing methods, such as inkjet, silkscreen and Gravure printing may be used at steps 302 and 304.

At step 306, at least the first and second portions of the layer of conductive ink and the layer of PTC conductive ink are sealed. Optionally, exposed portions of the substrate, and portions of the third portion of the layer of conductive ink, other than the component connection regions, may also be sealed at step 306. The sealing carried out at step 306 may comprise applying one or more coatings of insulating sealant, or may comprise adhering one or more insulating sheets over at least the first and second portions of the layer of conductive ink and the layer of PTC conductive ink.

At optional step 308, which may be included in the method 300 where the layer of conductive ink deposited at step 302 includes a third portion arranged to form control circuit conductive paths for a control circuit, electrical components are electrically coupled to the third portion of the layer of conductive ink to form a control circuit. As described above, the control circuit includes a capacitive switch incorporating the capacitive sensor electrode and is adapted to selectively control flow of electrical current through the first portion of the layer of conductive ink and the layer of PTC conductive ink in response to the capacitive switch. With the control circuit complete, the first portion of the layer of conductive ink and the second portion of the layer of conductive ink are in electrical communication with one another only through the control circuit. At optional step 310, after electrically coupling the electrical components to the third portion of the layer of conductive ink at step 308, the third portion of the layer of conductive ink may be sealed.

After step 308, or after optional step 310 when present, the method ends.

Various currently preferred embodiments have been described by way of example. It will be apparent to persons skilled in the art that a number of variations and modifications can be made without departing from the scope of the claims.

What is claimed is:

1. A heatable surface element, comprising:

an insulating substrate;

a layer of conductive ink on the substrate, wherein:

a first portion of the layer of conductive ink is arranged to form an open heater circuit pattern comprising a plurality of heater conductive paths separated from one another by gaps therebetween; and a second portion of the layer of conductive ink is arranged to form a capacitive sensor electrode spaced from and electrically isolated from the first portion of the layer of conductive ink by a peripheral isolation region surrounding the capacitive sensor electrode;

a layer of positive temperature coefficient (PTC) conductive ink on the substrate and the first portion of the layer of conductive ink in electrical communication therewith to bridge the gaps between the heater conductive paths of the open heater circuit pattern;

the capacitive sensor electrode being spaced from and electrically isolated from the layer of PIG conductive ink on the first portion of the layer of conductive ink by the peripheral isolation region; and at least one insulating sealing layer;

wherein the first and second portions of the layer of conductive ink and the layer of PTC conductive ink are disposed between the substrate and the at least one sealing layer.

2. The heatable surface element of claim 1, wherein:

a third portion of the layer of conductive ink is arranged to form control circuit conductive paths for a control circuit; and the third portion of the layer of conductive ink is electrically coupled to the first portion of the layer of conductive ink and to the second portion of the layer of conductive ink so as to maintain electrical isolation therebetween.

3. The heatable surface element of claim 2, wherein at least component connection regions of the third portion of the layer of conductive ink are unsealed by the sealing layer.

4. The heatable surface element of claim 2, wherein the at least one sealing layer comprises a coating of sealant over the first and second portions of the layer of conductive ink and over the layer of PTC conductive ink.

5. The heatable surface element of claim 2, wherein the at least one sealing layer comprises a sheet adhered over the first and second portions of the layer of conductive ink and over the layer of PTC conductive ink.

6. The heatable surface element of claim 1, wherein the capacitive sensor electrode is free of PCT conductive ink.

7. A heater, comprising:

a control circuit; and a heatable surface element;

the heatable surface element comprising:

an insulating substrate;

a layer of conductive ink on the substrate, wherein:

a first portion of the layer of conductive ink is arranged to form an open heater circuit pattern comprising a plurality of heater conductive paths separated from one another by gaps therebetween; and a second portion of the layer of conductive ink is arranged to form a capacitive sensor electrode spaced from and electrically isolated from the first portion of the layer of conductive ink by a peripheral isolation region surrounding the capacitive sensor electrode;

the first portion of the layer of conductive ink and the second portion of the layer of conductive ink being in electrical communication with one another only through the control circuit;

a third portion of the layer of conductive ink arranged to form control circuit conductive paths for the control circuit;

a layer of positive temperature coefficient (PTC) conductive ink on the substrate and the first portion of the layer of conductive ink in electrical communication therewith to bridge the gaps between the heater conductive paths of the open heater circuit pattern;

at least one sealing layer;

wherein:

the first and second portions of the layer of conductive ink and the layer of PTC conductive ink are disposed between the substrate and the at least one sealing layer;

the third portion of the layer of conductive ink is electrically coupled to the first portion of the layer of conductive ink and to the second portion of the layer of conductive ink so as to maintain electrical isolation therebetween except through the control circuit; and the capacitive sensor electrode is spaced from and electrically isolated from the layer of PTC conductive ink on the first portion of the layer of conductive ink by the peripheral isolation region;

the control circuit including control circuit conductive paths formed by the third portion of the layer of conductive ink; and the control circuit including a capacitive switch incorporating the capacitive sensor electrode and being adapted to selectively control flow of electrical current through the first portion of the layer of conductive ink and the layer of PTC conductive ink in response to the capacitive switch.

8. The heater of claim 7, wherein the at least one sealing layer comprises a coating of sealant over the first and second portions of the layer of conductive ink and over the layer of PTC conductive ink.

9. The heater of claim 7, wherein the at least one sealing layer comprises a sheet adhered over the first and second portions of the layer of conductive ink and over the layer of PTC conductive ink.

10. The heater of claim 7, wherein the capacitive sensor electrode is free of PCT conductive ink.

* * * * *